US005107740A

United States Patent [19]

Strathmann

[11] Patent Number: 5,107,740

[45] Date of Patent: Apr. 28, 1992

[54] FLUTE MOUTHPIECE WITH ADJUSTABLE CORE GAP

[76] Inventor: Arnfred R. Strathmann, Dorfstrasse 31, Melsdorf, Fed. Rep. of Germany, 2300

[21] Appl. No.: 613,610

[22] Filed: Nov. 9, 1990

[30] Foreign Application Priority Data

Nov. 10, 1989 [DE] Fed. Rep. of Germany ..... 3937500

[51] Int. Cl.[5] ..... G10D 7/02

[52] U.S. Cl. ..... 84/384; 84/383 R

[58] Field of Search ..... 84/380 R, 383 R, 384

[56] References Cited

U.S. PATENT DOCUMENTS 3,178,986 4/1965 Moeck ..... 84/384

4,517,875 5/1985 Dossekker ..... 84/383 R

*Primary Examiner*—L. T. Hix

*Assistant Examiner*—Howard B. Blankenship

*Attorney, Agent, or Firm*—Townsend and Townsend

[57] ABSTRACT

In a flute mouthpiece the core has an upper section which points towards the interior of the mouthpiece, which is pivotably journalled and which can be adjusted in the vertical direction by an adjustment bar which is led out of the flute mouthpiece. In this flute mouthpiece the size of the core gap can be varied by the adjustable section so that a fine adjustment of the tone of the flute can be effected.

10 Claims, 1 Drawing Sheet

FLUTE MOUTHPIECE WITH ADJUSTABLE CORE GAP

BACKGROUND OF THE INVENTION

The invention relates to a flute mouthpiece.

Such mouthpieces are generally known, in particular in connection with recorders. In these flute mouthpieces the core customarily consists of cedar wood. After the recorder has been played for a long time the mouthpiece can swell through the moisture which emerges during playing from the mouth of the player of the flute, so that the dimensions of the core gap formed in the mouthpiece can change, which leads to a change of the quality of the sound and of the tone of the flute. This leads to the tone of the flute changing disadvantageously as the length of playing increases. A musician who practices frequently must thus have a number flutes in order to obtain a somewhat constant tone quality over the entire duration of practice by changing of the instruments.

SUMMARY OF THE INVENTION

It is thus the object of the invention to form a flute mouthpiece of the cited kind in such a way that a uniform tone quality is obtained even over a long playing time.

This object is satisfied in accordance with the invention in that the mouthpiece body of the flute has a longitudinal bore and a core insertable into the bore at one end of the body. A substantially rectangular cut-out is formed in the other side of the mouthpiece body in the region of the core and disposed in the interior of the mouthpiece, with the transverse edge of the rectangular cut-out remote from the core being formed as a lip and merging into an inclined surface which outwardly broadens the opening forming the cut-out. The upper surface of the core and the wall surface of the longitudinal bore adjacent to this upper surface are spaced apart from one another to form a core gap which has a blowing-in opening at its one end and a blowing-out opening at its other end pointing towards the lip. The core has a section which includes at least a part of the upper surface which is pivotable about an axis disposed at its end directed towards the blowing-in opening and which extends horizontally and transverse to the longitudinal bore to the end of the core disposed on the interior of the mouthpiece.

Through the possibility, given with the flute mouthpiece of the invention, of vertically pivoting the upper section of the core which points towards the interior of the mouthpiece, an adjustability of the vertical dimension of the core gap is achieved for the first time in a particularly simple manner. This adjustability of the vertical dimension enables the musician, on swelling of the mouthpiece, to reproduce the original ideal dimensions of the core gap by a simple vertical adjustment of the pivotable section and thus to re-obtain the desired tone quality.

Through the adjustability of the vertical core gap, and thus of the position of the inner upper edge of the core, which is given by the flute mouthpiece of the invention one can also basically adapt the characteristic of the flute mouthpiece so that a so-called "broad manner of construction" can for example be obtained when the upper edge of the core at the interior of the mouthpiece is set to a plane which lies lower than the edge of the lip, or a "narrow manner of construction" can for example be achieved when the upper edge of the core at the interior of the mouthpiece is adjusted into an approximately common plane with the edge of the lip.

The concept underlying the invention thus lies in making the upper edge of the core at the interior of a flute mouthpiece vertically adjustable so that the vertical dimension of the core gap can be individually selected and adjusted by the musician.

The upper surface of the core can also basically be bendable, however an advantageous embodiment is made such that the pivotable section of the core is an insert journalled in the core. This has the advantage that the manufacture is considerably simplified and the adjustable flute mouthpiece can be manufactured at favorable cost.

A particularly simple and advantageous layout for the actuation of the adjustment is to place an adjustment bar advantageously being inserted into the insert from below through the openings after insertion of the core into the mouthpiece. This takes place in a particularly advantageous manner with a screw screwed into the insert from below. In this embodiment a spring force is generated by exploiting the resilient characteristic of the resilient insert which simultaneously exerts a sealing function and the spring force brings the head of the screw into contact with the lower outer surface of the mouthpiece. By screwing-in the screw it is possible to broaden the core gap against the resilient force of the resilient insert. On unscrewing the screw the spring force serves for narrowing of the core gap.

A particularly cost favorable arrangement is obtained by constructing only the pivotable section of the core of wood, preferably of cedar wood or of a harder wood, or of a suitable synthetic material, in order to exploit the essential characteristic of the selected wood or synthetic material in this region, namely of ensuring the soaking up of the moisture of the respiratory air with a simultaneous small tendency to swell. The remainder of the core can then for example consist of a plastic material which can be simply manufactured at favorable cost.

The special construction of the pivotable section and of the core body has the advantage of being simpler to manufacture while simultaneously ensuring a transition zone between the upper surface of the core body and the lower surface of the pivotable section which is as free as possible from disturbances. Through this layout it is possible to avoid undesired separations of the flow which generally follows the upper surface of the core.

The embodiment of the invention in which the mouthpiece body above the core gap is formed by a cover enables simple cleaning of the mouthpiece in a particularly advantageous manner. It is advantageous that only the inner region which bounds the core gap consists of wood, whereas the remaining region can consist of another material, for example plastic. In order to reliably avoid strains in the wooden insert during securing of the mouthpiece cover a resilient insert is advantageously inserted between the wooden insert and the base of the cut-out in the mouthpiece cover. Through the resilient insert unequal force effects on the wooden insert arising from the fastening of the mouthpiece cover can be compensated. It is also particularly advantageous when the wooden insert is also manufactured of cedar wood.

BRIEF DESCRIPTION OF THE DRAWINGS

The invention will subsequently be explained in more detail with reference to an embodiment and to the drawing in which are shown.

DESCRIPTION OF THE PREFERRED EMBODIMENTS

Figure 1:
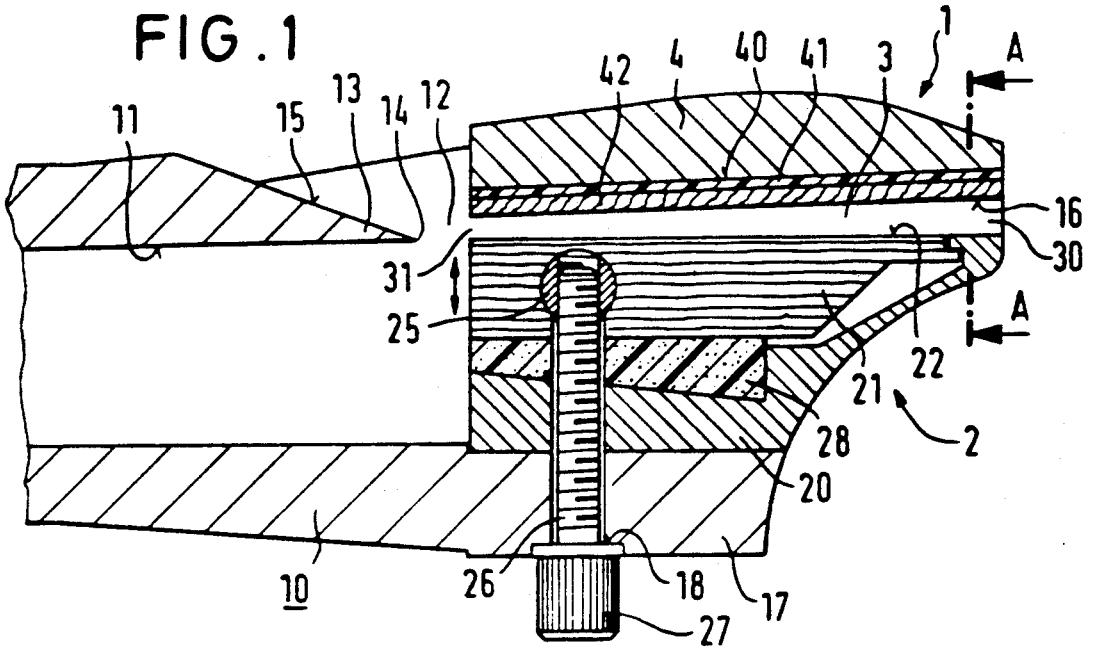
FIG. 1 a vertical longitudinal section through a flute mouthpiece in accordance with the invention, FIG. 2 a cross section along the line A—A in the viewing direction of the arrows, and FIG. 3 a section of the longitudinal section of FIG. 1 in the region of the pivotal mounting.

FIG. 1 shows a flute mouthpiece 1 which has a longitudinal bore 11. At the side of the lip projection a core 2 is inserted into the longitudinal bore 11 and only penetrates partially into this bore. The core 2 directly contacts the wall of the longitudinal bore 11 over approximately three quarters of its circumference. Only the upper surface 22 of the core is spaced from the wall surface 16 of the longitudinal bore 11 in this region, so that a wind channel termed a core gap 3 is formed between the upper surface 22 of the core 2 and wall surface 16. This wind channel has a blowing-in opening 30 at the lip-side end of the mouthpiece and the blowing-out opening 31 at its end in the interior of the mouthpiece.

In the region of the blowing-out opening 31, and thus simultaneously in the region of the end of the core in the interior of the mouthpiece, an upwardly directed radial opening termed a cut-out 12 is provided in the mouthpiece body 10. The cut-out 12 is bounded at its side disposed opposite to the blowing-out opening 31 by a lip 13 of which the lip edge 14 bounding the cut-out is formed as an acute angle. The lip has an inclined surface 15 which broadens the cut-out outwardly.

Figure 3:
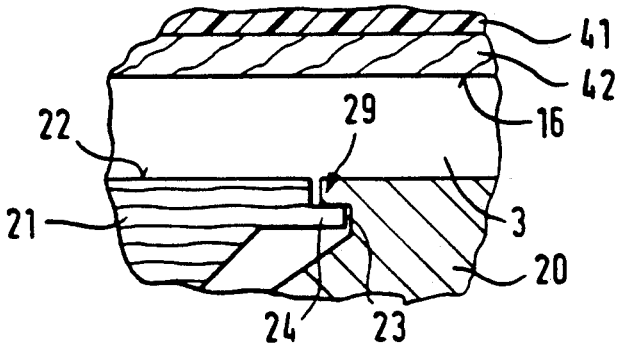

The core 2 consists of a core body 20 which bounds the core towards the outer side of the longitudinal bore and downwardly. The core body 20 also forms a part of the upper surface 22 of the core starting from the blowing-in opening 30. This part amounts to approximately one fifth to one third and preferably to one quarter of the total longitudinal extent of the upper surface 22. A groove-like undercut 23 which extends horizontally and transverse to the longitudinal bore, and which is open towards the inner side of the mouthpiece, is formed in the core body 20 at the end of this part in the interior of the mouthpiece, as shown in FIG. 3.

A tongue-like projection 24 of an insert 21, which is formed as a pivotable section of the core 2, is directed towards the blowing-in opening 30 and is so inserted into the undercut 23 that the undercut 23 and the projection 24 jointly form a pivot axis 29 for the insert 21. The insert 21 extends up to the end of the core in the interior of the mouthpiece and the upper surface of the insert piece 21 continues the upper surface 22 of the overall core 2 up to the blowing-out opening 31.

The insert 21 has an insert member 25 in the region of the end of the core 2 in the interior of the mouthpiece. The insert member extends transverse to the longitudinal bore through the insert 21 in its interior and which can also be pushed-in to the insert 21 from the side.

The insert member 25 is provided with a threaded bore which extends substantially vertically and which is accessible through an opening provided in the lower surface of the insert 21.

A resilient insert 28 is arranged between the lower surface of the insert 21 and the lower part of the core body 20. This resilient insert preferably extends over the entire width of the core and is thinner in the end region in the interior of the mouthpiece than at the opposite end. A bore formed as an extension of a threaded bore in the insert 25 and the opening in the lower surface of the insert 21 penetrates the resilient insert 28, the lower section of the core body 20 and the lower wall 17 of the mouthpiece body 10. A screw 26 is guided through this bore from below and is screwed into the threaded bore in the insert member 25. The screw 26 which serves as an adjustment bar lies with its head 27 contacting the outer surface of the lower wall 17 of the mouthpiece body 10 and is braced there against a contact collar extending perpendicular to the axis of the bore. The screw head 27 is preferably formed as a knurled head.

If the screw 26 is now turned then this brings about a pivoting of the insert 21 about the axis 29 in the direction of the double arrow. The screwing-in of the screw 26 into the thread in the insert piece 25 brings about a movement of the insert piece 21 in the clock-wise sense and thus a downward movement of the end of the insert 21 at the interior of the mouthpiece against the spring force of the resilient insert 28. In so doing the spacing between the wall surface 16 of the longitudinal bore 11 and the upper surface 22 of the core 2 in the region of the insert 21 increases, and thus the size of the blowing-in opening 31 also increases. The core gap becomes wider.

Screwing out of the screw 26 brings about, as result of the spring force of the resilient insert 28, a movement of the insert 21 in a counter clock-wise direction about the axis 29 and thus an upward movement of the end of the insert 21 in the interior of the mouthpiece. In this way the spacing between the wall surface 16 of the mouthpiece body 10 and the upper surface 22 of the core 2 in the region of the insert 21 is reduced, and thus the vertical extent of the blowing-in opening 31 is reduced. The core gap becomes narrower.

Figure 2:
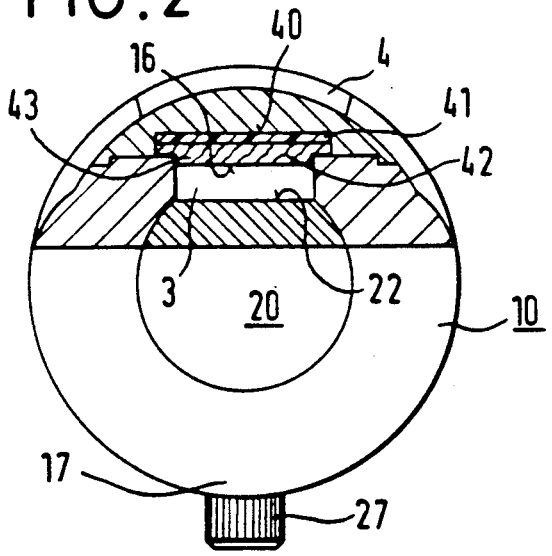

Above the core gap 3 the mouthpiece 10 has a removable mouthpiece cover 4. The mouthpiece cover 4 extends over the entire length of the gap and is secured in known manner to the mouthpiece body 10 by a clip. As FIG. 2 shows the mouthpiece cover is substantially broader than the core gap. The mouthpiece cover 4 has a cut-out 40 which is open towards the core gap 3 and which is likewise broader than the core gap 3. The cut-out 40 accommodates a wooden insert 42 which upwardly bounds the core gap 3 and which is itself broader than the core gap. A resilient insert 41 is provided between the wooden insert 42 in the base of the cut-out 40 and keeps the securing forces for the mouthpiece cover away from the wooden insert 42 as far as possible, so that the wooden insert 42 cannot distort. In this manner a good seal is ensured over the full length between the core gap 3 and the wooden insert 42 of the mouthpiece cover 4.

The wooden insert 42 of the cover 4 can be optionally provided with a step 43 which projects into the core gap and which also makes the upper side of the core gap variable to different degrees. This has the advantage that also children who for example, have available a small air volume can select any desired narrowing of the core gap.

I claim:

1. Flute mouthpiece comprising a mouthpiece body provided with a longitudinal bore, a core insertable into the longitudinal bore at one end of the mouthpiece body; a substantially rectangular cut-out formed in the upper side of the mouthpiece body in the region of the core end disposed in the interior of the mouthpiece, with the transverse edge of the rectangular cut-out remote from the core being formed as a lip and merging into an inclined surface which outwardly broadens the opening forming the cut-out, and wherein the upper surface of the core and the wall surface of the longitudinal bore adjacent to this upper surface are spaced apart from one another and form a core gap, and wherein the core gap has a blowing-in opening at its one end and a blowing-out opening at its other end pointing towards the lip, characterized in that the core (2) has a section (21) which includes at least a part of the upper surface (22), which is pivotable about an axis (29) disposed at its end (24) directed towards the blowing-in opening (30 and extending horizontally and transverse to the longitudinal bore, and which extends up to the end of the core disposed in the interior of the mouthpiece.

2. Flute mouthpiece in accordance with claim 1, characterized in that the pivotable section (21) of the core (2) is an insert which is journalled in the non-pivotable core body (20).

3. Flute mouthpiece in accordance with claim 1, characterized in that the pivotable section (21) has an insert (25) in the vicinity of its end disposed in the interior of the mouthpiece, with a vertically arranged adjustment bar (26) being secured in the insert (25) and projecting through the lower side of the pivotable section (21) and also the lower wall (17) of the mouthpiece body (10); and in that a resilient insert (28) is provided between the lower side of the pivotable section (21) and the core body (20).

4. Flute mouthpiece in accordance with claim 3, characterized in that the adjustment bar (26) consists of a screw which can be threaded into a substantially vertical threaded bore of the insert (25) and the head (27) of which is supported on the outer surface of the lower wall (17) of the mouthpiece body (10) against the spring force of the resilient insert (28).

5. Flute mouthpiece in accordance with claim 1, characterized in that the pivotable section of the core consists of wood, preferably of cedar wood and the core body (20) of plastic.

6. Flute mouthpiece in accordance with claim 1, characterized in that the pivot axis (29) of the pivotable section (21) is formed by a groove-like undercut (23) in the upper part of the core body (20) with the groove-like undercut extending horizontally and transverse to the longitudinal bore (11) and opening towards the interior of the mouthpiece, with a tongue-like projection (24) of the pivotable section (21) directed towards the blowing-in opening (30) pivotally engaging into the groove-like undercut.

7. Flute mouthpiece in accordance with claim 1 characterized in that the mouthpiece body (10) is formed in the region above the core gap (3) by a mouthpiece cover (4).

8. Flute mouthpiece in accordance with claim 7, characterized in that the mouthpiece cover (4) as a cut-out in its lower region pointing towards the core gap (3) and extending over its full length into which a wooden insert (42) is inserted; and in that the width of the cut-out (40) and of the wooden insert (42) is larger than the width of the core gap (3).

9. Flute mouthpiece in accordance with claim 8, characterized in that a resilient insert (41) is arranged between the base of the cut-out (40) under the wooden insert (42).

10. Flute mouthpiece in accordance claim 8, characterized in that the wooden insert (42) preferably consists of cedar wood.

* * * * *